US005385292A

United States Patent [19]

Labianca et al.

[11] Patent Number: 5,385,292

[45] Date of Patent: Jan. 31, 1995

[54] PIZZA BOX HAVING MOISTURE ABSORBENT MATERIAL

[75] Inventors: Giuseppe Labianca, Brewster; Richard L. Rosenberg, White Plains; Barry J. Jacobson, New York, all of N.Y.

[73] Assignee: Me & The Boys Pizza Emporium Inc., Yew York, N.Y.

[21] Appl. No.: 65,240

[22] Filed: May 20, 1993

[51] Int. Cl.[6] ..... B65D 81/26

[52] U.S. Cl. ..... 229/120; 229/906; 229/120.32; 426/124; 426/128; 426/118; 206/204

[58] Field of Search ..... 426/128, 124, 118, 113, 426/107; 229/902, 906, 120.19, 120.32, 120; 206/204

[56] References Cited

U.S. PATENT DOCUMENTS

| | | | |
|---|---|---|---|
| 3,026,209 | 3/1962 | Niblack et al. | 426/124 |
| 3,335,846 | 8/1967 | Mills | 426/118 |
| 3,484,015 | 12/1969 | Rowan | 426/118 |
| 3,515,331 | 6/1970 | Guthrie | 206/204 |
| 3,521,788 | 7/1970 | Kandel et al. | 426/118 |
| 3,583,407 | 6/1971 | Pokras | 131/203 |
| 3,721,803 | 3/1973 | DiStefano | 426/113 |
| 3,756,681 | 9/1973 | Croston | 426/124 |
| 3,915,532 | 10/1975 | Ashton | 406/124 |
| 3,933,295 | 1/1976 | Congleton | 426/128 |
| 4,058,214 | 11/1977 | Mancuso | 426/128 |
| 4,237,171 | 12/1980 | Laage et al. | 426/128 |
| 4,260,060 | 4/1981 | Faller . | |
| 4,373,636 | 2/1983 | Hoffman | 426/128 |
| 4,441,626 | 4/1984 | Hall | 426/128 |
| 4,756,939 | 7/1988 | Goodwin | 206/204 |
| 4,883,195 | 11/1989 | Ott et al. | 426/118 |
| 4,919,326 | 4/1990 | Deiger . | |
| 5,002,221 | 3/1991 | Ragan | 426/128 |
| 5,052,559 | 10/1991 | Bressi, Jr. . | |
| 5,180,075 | 1/1993 | Montalbano | 426/128 |

*Primary Examiner*—Steven Weinstein
*Attorney, Agent, or Firm*—Darby & Darby

[57] ABSTRACT

A package for heated carry-out food such as pizza pie, includes a box structure made up of side walls, a bottom panel and a closure lid. The side walls and the bottom panel define an interior compartment which is suitable for holding the heated food. A steam permeable support member, such as a sheet of balsa wood, is positioned within the interior compartment for supporting the heated food. The wooden support member allows for the passage of steam away from the heated food. The support member is elevated above the bottom surface of the box so that any condensing water from within the wooden support member is encouraged to collect below the support member and away from the heated food. Means for elevating the support member is included.

6 Claims, 3 Drawing Sheets

PIZZA BOX HAVING MOISTURE ABSORBENT MATERIAL

FIELD OF THE INVENTION

This invention is directed to packaging and, more particularly, to box-like packages used to carry pizza pies which are typically assembled from a single cut-out panel of cardboard and used to transport a pizza pie (or a similar food item) from a restaurant, for example to a location for food consumption.

BACKGROUND OF THE INVENTION

In the field of packaging hot carry-out food, such as pizza, a common goal has been to protect the food by maintaining a desirable high food-temperature and retaining the desirable characteristics and quality of the particular food, such as, in the case of pizza, a crispy crust. One particular problem is controlling the release of water vapor (steam) from the package without losing heat from the food. If the steam is not released from the package, it will generally condense within the package, eventually soaking the food item, and resulting in a loss of both product crispness (e.g., the pizza crust will become soggy) and product quality.

The prior art, including U.S. Pat. No. 5,052,559 to Bressi, Jr., U.S. Pat. No. 4,260,060 to Faller and U.S. Pat. No. 4,919,326 to Deiger, has recognized the importance of preventing the build-up of steam within the package adjacent to the otherwise crispy food product. For the most part, the prior art relies on a combination of vents, formed within the walls of the package to release any steam from the food, and tabs which raise the food above a bottom surface of the package. Although these prior art methods and structures may be effective in removing steam from the package, they fail to maintain adequate food temperature. Too much convection within the package draws too much heat from the food, resulting in a cold, albeit crispy food product. Further, without adequate support a product, such as a pizza, may collapse, particularly when the crust becomes soggy.

It is accordingly an object of the invention to provide a package for carry-out food which overcomes the above-mentioned problems.

It is another object of the invention to provide a package which prevents steam from condensing onto or within a food product, while maintaining a desirable food temperature.

SUMMARY OF THE INVENTION

A package for heated carry-out food, such as pizza pie, includes a box structure made up of side walls, a bottom panel and a closure lid. The side walls and the bottom panel define an interior compartment which is suitable for holding the heated food. A steam permeable support member, such as a sheet of balsa wood, is positioned within the interior compartment for supporting the heated food. The wooden support member helps absorb and allow the passage of any steam from the heated food. The wooden support member is elevated above the bottom surface of the box so that any condensing water from within the wooden support member is encouraged to pass through below the support member and away from the heated food. Means for elevating the support member is included.

DETAILED DESCRIPTION OF THE PREFERRED EMBODIMENT

Figure 1:
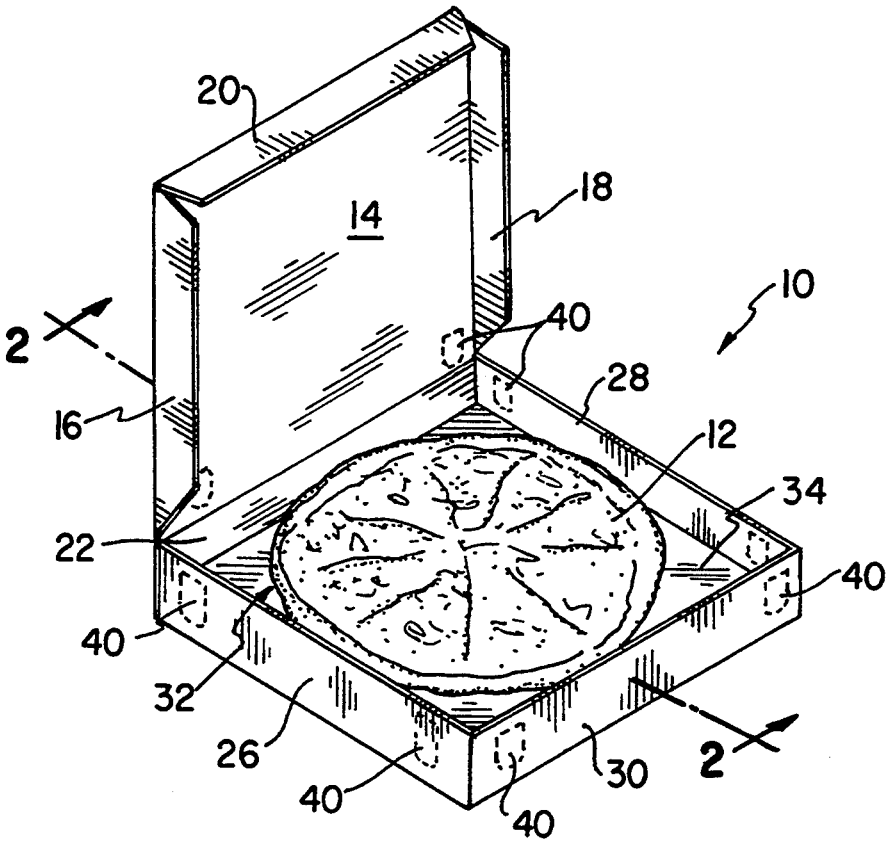
FIG. 1 is a perspective view of an open pizza pie box in accordance with the present invention.

Referring to FIG. 1, an open pizza box 10 in accordance with the present invention is illustrated holding a pizza pie 12. The basic construction of the box 10 is conventional in that it is made from a cardboard (or similar) material and includes a top panel 14, a top left-side panel 16, a top right-side panel 18, a top front panel 20, a rear panel 22, a bottom panel 24, a bottom left panel 26, a bottom right panel 28, and a bottom front panel 30, all formed integrally from a single die-cut master panel (not shown). The above-mentioned panels may be interlocked together to form the pizza box and define a pizza compartment 32 for holding a pizza pie 12. Although the preferred box of the invention described hereinafter refers to a pizza-type box, it is understood that the invention may be applied to any type and shape of package for carrying any type and shape of heated food.

Figure 2:
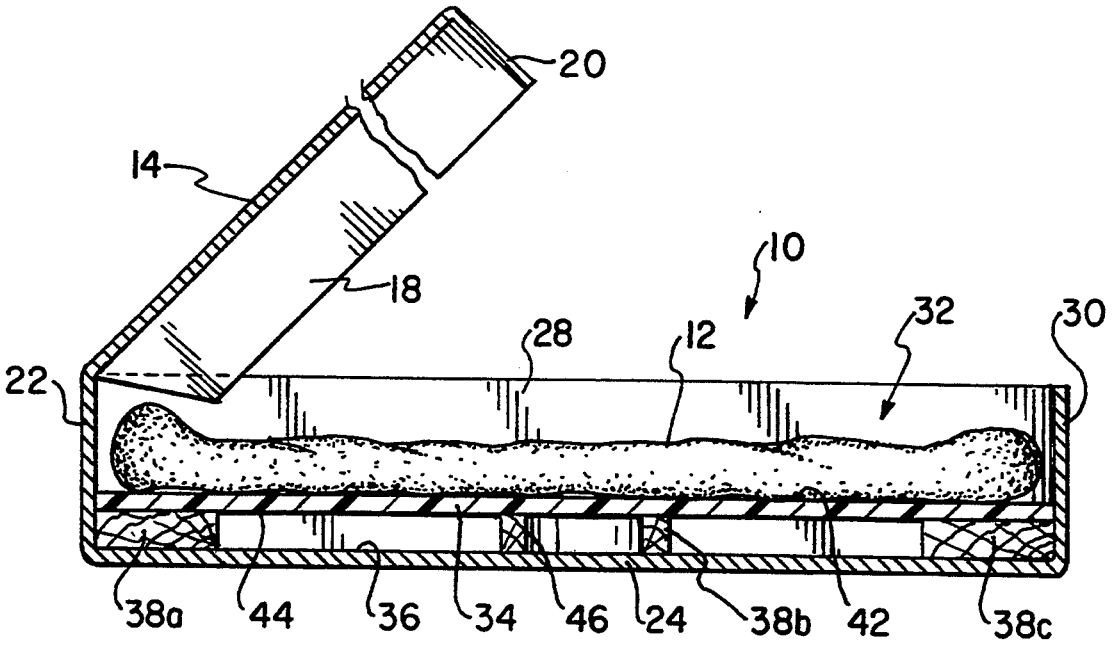
FIG. 2 is a cross-sectional view taken along the line 2—2 of FIG. 1 showing details of the pizza pie box including an elevated support member in accordance with the invention.
Figure 4:
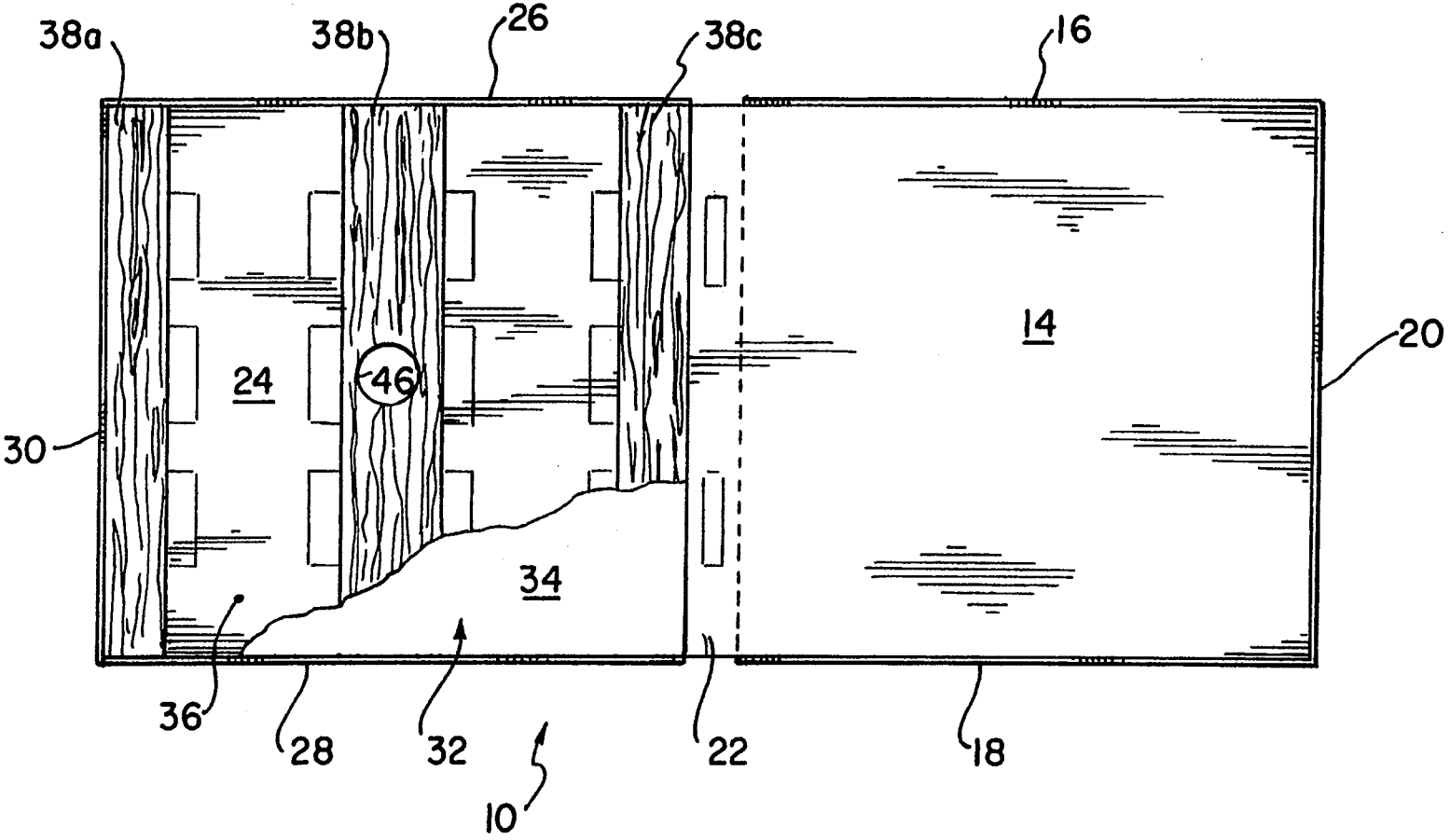
FIG. 4 is a plan view of an open pizza pie box showing spacer blocks in accordance with the invention.

As shown in FIGS. 1, 2, and 4 a support sheet 34 is positioned within the pizza compartment 32 of the box 10. The support sheet 34 is mounted above an upper (inside) surface 36 of the bottom panel 24. The support sheet 34 directly contacts and supports the underside of a pizza pie 12 so that the pizza pie 12 is supported above the upper surface 36 of the bottom panel 24. Spacer blocks 38*a*–38*c* are used to position the support sheet above the upper surface 36 of the bottom panel. Although this is a preferred method of supporting the support sheet 34 above the bottom panel 24, any appropriate method for doing the same may be employed.

Figure 3:
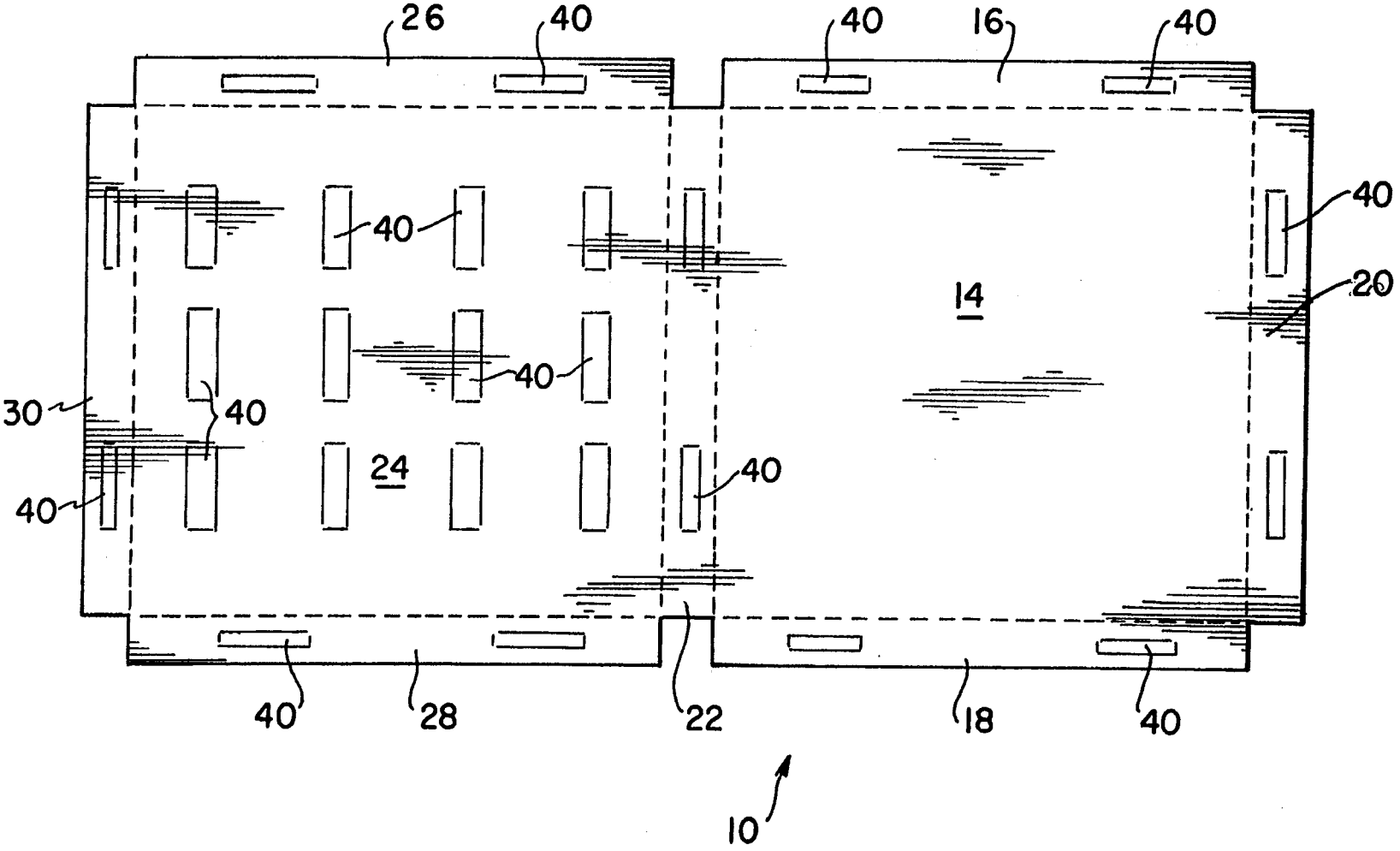
FIG. 3 is a plan view of a die-cut cardboard master panel of an unfolded pizza box showing a preferred venting arrangement.

As illustrated in FIG. 3, a plan view of a cardboard die-cut master panel of the pizza box 10 of FIG. 1, is shown with a preferred vent arrangement. As shown, the cardboard master die-cut panel includes several selectively activated vents 40 which are defined using perforations along any panel section of the box 10. Once activated, the open vents 40 assist in removing excess steam, as described below. There are preferably twelve vents 40 located on the bottom panel 24. The vents 40 are evenly spaced and may be formed using selective perforating the cardboard bottom panel 24 so that each vent may be selectively opened, depending on the application and the degree of venting required. For a pizza pie box application, the vents are preferably about ¼" wide, and 1" in length. There are similarly sized vents 40 located along each side panel 16, 18, 26, and 28, and along the front panels 20 and 30, each vent being adapted to be pushed open when desired. In the preferred pizza pie box, there are no vents located on the top panel 14.

In a preferred embodiment, the support sheet 34 is made from a single sheet of ⅛" balsa wood. The size of the support sheet 34 is preferably equal to the size of the bottom panel 24. Although a single sheet of balsa wood is preferred, the support sheet 34 may also be made from several smaller pieces of balsa wood. For example, a one foot square support sheet 34 may be constructed using four sheets that are each 3" wide and 12" long positioned side by side on the spacer blocks 38*a*–38*c*.

As shown in FIG. 4, the space blocks 38*a*–38*c* may be made from scrap pieces of balsa wood or cardboard, or other appropriate materials. The spacer blocks 38*a*–38*c* preferably extend the width of the pizza box 10 between the bottom right panel 28 and the bottom left panel 26. The spacer blocks 38*a*–38*c* are preferably about 1" wide, ¼" thick and are positioned along the bottom panel 24 between the vents 40, as shown in FIG. 4. A center spacer block 38*b* includes a centrally located opening 46. The position of the opening 46 is both in the center of the center spacer block 38*b* and also the center of the pizza box 10, as shown in FIG. 4. The purpose of the opening 46 is to collect any condensation from the center of the pizza pie 12. The size of the central opening 46 is preferably as large as structurally possible or as close to 1" as the 1" wide central spacer block 38*b* will allow.

Balsa wood has been found to quickly pass moisture, especially steam, and permit it to permeate through the wood. The balsa wood support sheet 34 functions as both an insulator and a support. The support sheet 34 helps prevent heat loss from the pizza pie 12. An upper surface 42 of the support sheet 34 remains hot relative to a lower surface 44 of the support sheet 34. The lower cooler surface 44 will thereby encourage any condensing water from the wooden support sheet 34 to condense away from the pizza pie 12. The resulting vapor or condensate will be passed downwardly towards the upper surface 36 of the bottom panel 24, and away from the pizza pie. An appropriate vent 40 may be preferably positioned along the bottom panel 24 to help evaporate excess condensed moisture.

What is claimed is:

1. In a package for transporting heated carry-out food that releases steam and has crispy portions, said package comprising a box having side walls, a bottom panel and a closure panel, said side walls being attached to said bottom panel along the periphery of said bottom panel, said bottom panel and said side walls defining an interior compartment, the improvement comprising:

a support member made of wood in sheet form and positioned within said interior compartment for supporting said heated food, said support member having both a flat upper surface which directly supports said heated food, and a lower surface, said support member being elevated above said bottom panel and being substantially equal to the size of said bottom panel;

means separate from said support member for elevating said support member above said bottom panel, said elevating means creating a space defined by and located between said bottom panel and said lower surface of said support member; and at least one opening located within said bottom panel;

said wood being sufficiently naturally steam permeable such that the wooden sheet support member absorbs steam released from the hot food and allows the steam to permeate through the support member and pass to said space below the support member and away from the heated food where it can condense on said lower surface of said support member which is cooler than said upper surface;

said at least one opening in said bottom panel being sufficient to allow evaporation of excess condensed moisture that has passed through the wooden support member to said space below.

2. The package according to claim 1, wherein said wooden steam permeable support member is made from balsa wood.

3. The package according to claim 1, wherein said elevating means includes spacers positioned between said support member and said bottom panel.

4. The package according to claim 3, wherein said spacers are made from wood.

5. The package according to claim 3, wherein said spacers are made from cardboard.

6. The package according to claim 1, wherein said elevating means includes tabs which are integrally formed with said box, said tabs protruding into said interior compartment to provide elevating support to said support member.

* * * * *

UNITED STATES PATENT AND TRADEMARK OFFICE

CERTIFICATE OF CORRECTION

PATENT NO. : 5,385,292

DATED : Jan. 31, 1995

INVENTOR(S) : Giuseppe Labianca, et al

It is certified that error appears in the above-identified patent and that said Letters Patent is hereby corrected as shown below:

In the cover page of the patent, Section (73), please delete "Yew York, N.Y." and substitute therefor --New York, N.Y.--.

Signed and Sealed this

Eleventh Day of April, 1995

*Attest:*

*Attesting Officer*

Bruce Lehman

BRUCE LEHMAN

*Commissioner of Patents and Trademarks*